US006511054B1

(12) United States Patent
Green

(10) Patent No.: US 6,511,054 B1
(45) Date of Patent: Jan. 28, 2003

(54) POROUS AIR DIFFUSER FOR TREATMENT OF LIQUIDS

(76) Inventor: Truman Green, 102 Ridgefield Dr., Wetumpka, AL (US) 36093

( * ) Notice: Subject to any disclaimer, the term of this patent is extended or adjusted under 35 U.S.C. 154(b) by 0 days.

(21) Appl. No.: 09/684,715

(22) Filed: Oct. 5, 2000

(51) Int. Cl.[7] ..... B01F 3/04
(52) U.S. Cl. ..... 261/122.1; 261/124
(58) Field of Search ..... 261/120, 122.1, 261/122.2, 124, DIG. 70; 210/221.1, 221.2

(56) References Cited

U.S. PATENT DOCUMENTS

| | | | | | |
|---|---|---|---|---|---|
| 2,383,946 | A | | 9/1945 | Tietig | |
| 2,807,505 | A | | 9/1957 | Weitzel | |
| 3,063,689 | A | | 11/1962 | Coppock | |
| 3,186,644 | A | * | 6/1965 | Ross et al. | 261/122.1 |
| 3,293,861 | A | | 12/1966 | Hinde | |
| 3,552,654 | A | | 1/1971 | Thomas | |
| 3,677,936 | A | | 7/1972 | Bastiaanse | |
| 3,733,064 | A | * | 5/1973 | Branton | 261/122.1 |
| 3,880,965 | A | | 4/1975 | Dudis | |
| 4,003,408 | A | | 1/1977 | Turner | |
| 4,110,420 | A | | 8/1978 | Turner | |
| 4,118,447 | A | * | 10/1978 | Richter | 261/122.1 |
| 4,168,779 | A | | 9/1979 | Turner | |
| 4,776,127 | A | | 10/1988 | Jackson | |
| 4,960,546 | A | * | 10/1990 | Tharp | 261/122.1 |
| 5,334,336 | A | | 8/1994 | Franz | |
| 5,560,875 | A | * | 10/1996 | Meshengisser et al. | 261/122.1 |
| 5,660,209 | A | | 8/1997 | Franz | |
| 5,811,164 | A | | 9/1998 | Mitchell | |
| 5,846,412 | A | | 12/1998 | Tharp | |
| 5,851,447 | A | | 12/1998 | Tyer | |
| 5,851,448 | A | | 12/1998 | Tyer | |
| 6,030,558 | A | | 2/2000 | Smith | |
| 6,086,056 | A | * | 7/2000 | Leask et al. | 261/120 |

* cited by examiner

*Primary Examiner*—C. Scott Bushey
(74) *Attorney, Agent, or Firm*—Bradley Arant Rose & White LLP

(57) ABSTRACT

A porous diffuser is disclosed. The porous diffuser can be in the form of a hose or other structure, the wall of the hose or structure having many small and irregularly shaped channels and pores that allow gas to seep out of the hose into the liquid. The diffuser receives air, oxygen or other gasses, and releases these gasses as bubbles into the liquid through the channels and pores. As the bubbles migrate in the liquid, they diffuse their gas into the liquid, as well a mix the liquid. The porous diffuser also provides for convenient methods to purge the system of liquid that has seeped into the diffuser during normal use and to retrieve the diffuser when maintenance, repair or replacement is required. An anchoring system can be incorporated with the porous diffuser to overcome buoyancy problems associated with gas in a liquid environment which can reduce or prevent proper gas distribution.

13 Claims, 5 Drawing Sheets

POROUS AIR DIFFUSER FOR TREATMENT OF LIQUIDS

FIELD OF INVENTION

The present invention relates to the treatment of liquids, and specifically to a porous diffuser for the aeration and mixing of liquids.

DEFINITIONS

The following words should be given the meanings below when interpreting the specification and claims. "Aerate" shall mean to treat a liquid with air, oxygen or other gasses. "Aeration system" shall mean the system comprising all the components necessary to aerate a body of liquid. "Diffuser" shall mean an apparatus for aerating water or other liquids. "Gas" shall mean any substance that is composed of constituent molecules that have the ability to expand indefinitely, as opposed to a solid or liquid. "Liquid" shall mean any substance that is composed of constituent molecules that move freely among themselves, but do not tend to separate like the molecules of gasses. "Porous diffuser" shall mean a diffuser composed of porous material, whether the diffuser is in the form of a hose, tube, sheet or other configuration. "Purging mechanism" shall mean any element (including, but not limited to, a stopper, cap, valve, piece of cloth etc.) inserted into or attached (permanently or removably) to the porous diffuser or the outlet pipe attached to the porous diffuser that can alternate between a closed position (defined as a position that prevents gas from exiting through the end of the porous diffuser or outlet pipe) and an open position (defined as a position that allows gas to exit through the end of the porous diffuser or outlet pipe).

BACKGROUND

In many instances, it is desirable to aerate liquids. For instance, in wastewater treatment plants, the bacteria that break down impurities in the wastewater during the treatment process depend on diffused oxygen in the water to flourish and complete the purification process. In aquaculture applications, such as the farming of fish, it is highly beneficial to maintain a stable, optimal concentration of diffused oxygen in the water to allow the fish to mature at optimal rates. Likewise, the ecology of lakes and streams depends on maintenance of a minimal concentration of oxygen to support the propagation of fish and other biota. As a result of pollution, the oxygen concentration in lakes and streams may decrease, with a corresponding decrease in the population of aquatic life. These are just several of the situations where aeration of liquids is appropriate, and is not meant to be an exhaustive list.

To address these situations, aeration systems have been employed. Several parameters impact the efficiency, operation and reliability of the aeration systems. Most aeration systems include some type of diffuser that releases gas into the liquid, usually in the form of bubbles, through holes or slits in the diffuser. Diffusers that produce a fine bubble pattern greatly increase the rate of gas absorption into the liquid as compared with diffusers that produce a coarse (larger) bubble pattern. As a direct result of the increased absorption rate, less energy is required to aerate a given body of liquid, which greatly decreases the cost of operation of the system (sometimes as much as a 50% reduction in energy costs). In addition, it is desirable to locate the diffusers of the aeration system in a total basin coverage pattern at or near the bottom of the body of liquid. This is so because bubbles produced by diffusers in such patterns reduce air flow rates, reduce the chimney effect caused by the upward velocity of the bubbles, and thus take longer to reach the surface. Hence, the bubbles have a longer time to transfer their gas to the surrounding liquid (referred to in the art as increased "residence time"). Unlike some diffusers located on the side of a basin, which depend on upward velocities to aerate and mix the entire basin, total basin coverage arrangements can be used to aerate the basin as well as mix the basin due to their pattern of placement.

However, aeration systems with diffusers mounted over the entire bottom of the basin as described above, although more efficient in gas transfer, are more difficult to service, repair or replace than aeration systems with diffusers mounted on the side of a basin. Service, repair or replacement of the diffusers is a critical factor as the liquids to be treated often contain impurities (including, but not limited to, microscopic and macroscopic particulate matter, plant matter and living organisms). The impurities in the liquid become deposited in the diffuser as the water carrying the impurities seeps back into the diffuser during periods of non-use (when the gas is not being forced through the diffuser). This means the aeration system is prone to malfunction as the holes, slits or porous openings in the diffusers designed to release gas to the surrounding liquid become clogged or blocked. As a result, the operation of the aeration systems becomes suboptimal and service, repair or replacement of the diffusers is required to restore the aeration system to optimal operating conditions. As most of the aeration systems employ diffusers that are permanently fixed to the bottom of the basin, to access these diffusers requires that the basin be emptied of liquid (which in the case of a natural body of liquid is often impossible) or that dangerous activity on the surface of the liquid be undertaken. Finally, since large volumes of liquid are generally required to be treated, the aeration systems need to be economical to purchase, install and replace.

As an example of these difficulties, consider aeration systems designed for use in wastewater treatment plants. These aeration systems can include a series of supply pipes that supply pressurized gas, usually air or oxygen, to diffusers of various types. The diffusers normally take the form of numerous tubes, plates, domes or discs. These diffusers release gas into the liquid, generally as fine bubbles. The bubbles then transfer the gas into the surrounding liquid. Many of the aeration systems currently in commercial operation use porous diffusers made of ceramics, plastics or flexible sheaths to release gas into the liquid, while some diffusers use pipes with holes of slits to achieve this purpose. These porous materials, holes or slits eventually become blocked as liquid seeps into the diffuser through the porous material, holes or slits and deposits sediments or chemical precipitates into the diffuser, clogging them. As a result, the efficiency of the diffuser is greatly decreased and the diffuser must be serviced, replaced or repaired. In place service of a diffuser of the type described may consist of flushing the diffuser with hydrochloric acid, an operation which entails significant danger. If this hydrochloric acid treatment fails, then the diffusers must be repaired or replaced. Since the diffusers are generally permanently mounted at the bottom of the basin, repair or replacement of the diffusers involves draining the liquid from the basin to access the diffusers. This can be a costly and time consuming process. Of particular concern in the field of wastewater treatment, if the facility does not have two operational wastewater treatment basins, wastewater treatment operations must be suspended while the repair or replacement takes place. Additionally, when draining the basin it is frequently necessary to release raw sewage into the natural environment.

Therefore, a need exists for an aeration system, particularly for wastewater treatment applications, that uses a limited number of long, porous diffusers which can be located on the bottom of a basin in a full-floor pattern design which operates efficiently, is economical to install, is capable of extended operation without maintenance, and is easy to remove, repair or replace when necessary.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION

Figure 1:
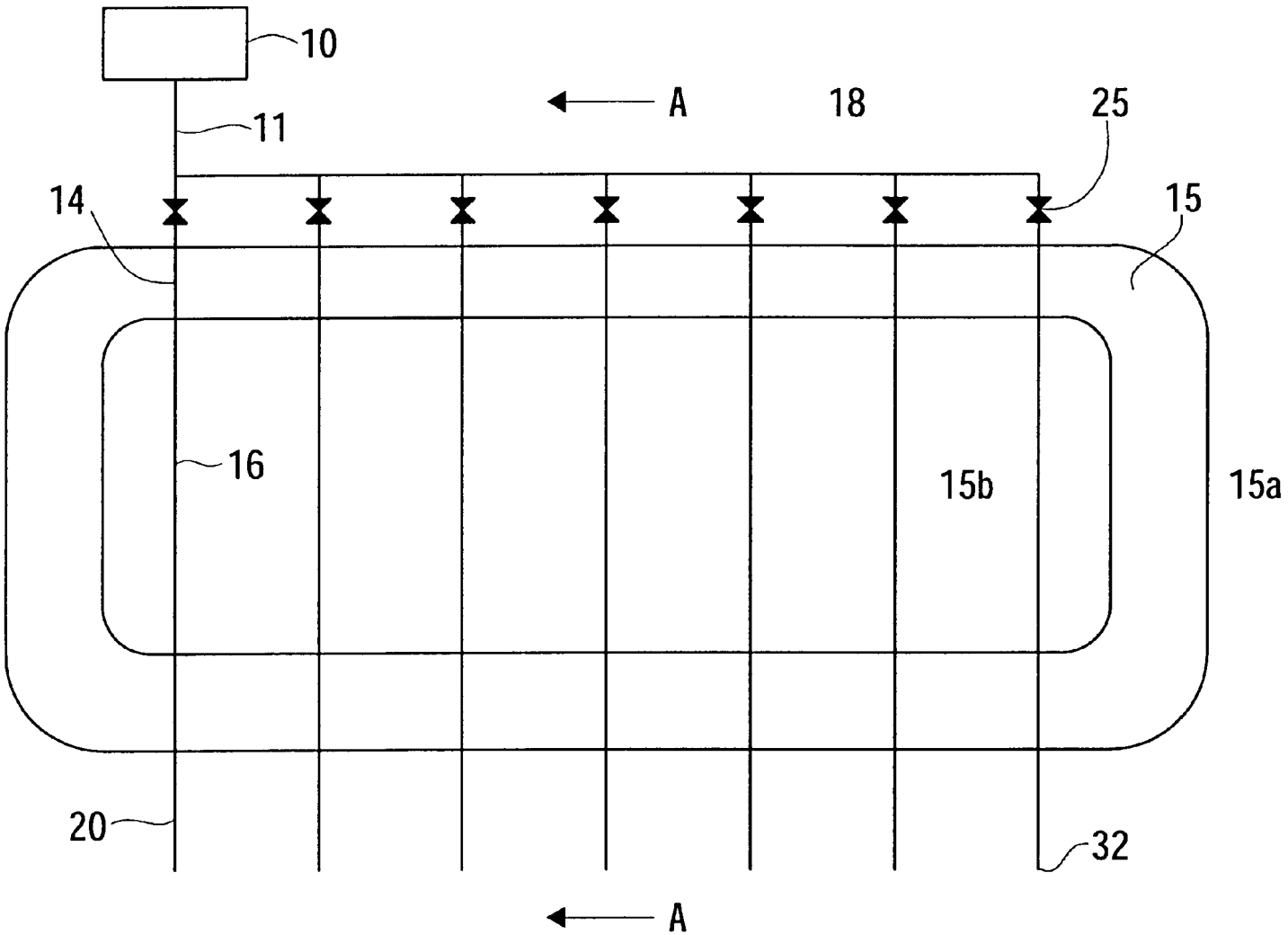
FIG. 1 is a typical plan view layout for an aerated lagoon/basin wastewater treatment system, incorporating an embodiment of the aeration system disclosed.

Referring initially to FIG. 1, an embodiment of the aeration system designed for wastewater treatment applications is illustrated. A series of supply pipes connects a blower 10 to the porous diffusers 16. The arrangement of these supply pipes is not critical to the practice of the invention, and the particular structure illustrated is shown for sake of clarity only, and is not meant to exclude other arrangement of supply pipes that can be envisioned by one of ordinary skill in the art in the field of wastewater treatment. A standard blower or low pressure air compressor 10 supplies gas to outlet pipe 11. One end of outlet pipe 11 is adapted to connect to blower 10, and the opposite end of the outlet pipe 11 is adapted to connect to supply manifold pipe 18. Connected to supply manifold pipe 18 is at least one feeder pipe 14. Each feeder pipe 14 is connected to at least one porous diffuser 16. Each feeder pipe 14 may be fitted with a shutoff valve 25 to individually regulate gas flow to the porous diffusers 16. The porous diffuser 16 extends across the body of liquid to be aerated. Attached to the end of the porous diffuser 16 opposite the attachment to the feeder pipe 14 is an outlet pipe 20. The outlet pipe extends to the outer portion 15A of basin 15. The outlet pipe 20 is capped on the end opposite the attachment to the porous diffuser 16 with a purging mechanism 32 (to be described below).

Gas is forced through outlet pipe 11 by blower 10 to the supply manifold pipe 18. Supply manifold pipe 18 distributes the gas to at least one feeder pipe 14 connected to supply manifold pipe 18. If the feeder pipe 14 contains a shutoff valve 25, the valve is placed in an open position to allow the feeder pipe 14 to distribute gas to its attached porous diffuser 16. If maintenance, repair or replacement of the porous diffuser 16 is required, the shutoff valve 25 is placed in a closed position. This allows each porous diffuser 16 to be accessed individually without shutting of the flow of gas to every porous diffuser 16. The gas escapes from the porous diffuser 16 into the liquid medium in the form of fine bubbles or coarse bubbles, depending on the pore size of the material from which the porous diffuser 16 is constructed. Methods are known in the art for manufacturing porous materials of varying pore sizes that could be used in the construction of the porous diffuser 16. The bubbles will discharge from the entire length of the porous diffuser 16, which will mix the liquid as well as diffuse gasses to the surrounding liquid. The gas is prevented from escaping through the end of the outlet pipe 20 by the purging mechanism 32.

Porous material suitable for construction of the porous diffuser 16 is commercially available in the form of porous hose, tubes and pipes manufactured primarily from recycled rubber as described in U.S. Pat. Nos. 5,368,235, 5,299,885, 4,616,055, 4,517,316 (which are incorporated by reference herein), and manufactured from 100% PVC, as embodied by soaker hoses sold by Dayco Swan. These products have in common the feature that they are manufactured in such a manner so that they have a multiplicity of small, irregularly shaped channels and pores that extend through the walls of the hoses. Gas escapes through these channels and pores into the liquid as bubbles, but water is substantially inhibited from entering the porous diffuser 16 through these channels and pores.

Although FIG. 1 shows the porous diffuser 16 as a commercially available porous water soaker hose, the porous diffuser 16 may consist of any porous material that allows gas to escape through the diffuser 16, while substantially impeding the flow of liquid into the diffuser 16 when the diffuser 16 is not in use. The material for the porous diffuser 16 can be fashioned into hoses or tubular pipes. Additionally, the soaker hose material can be fashioned into a sheet of diffuser material which can be stretched over frames, domes, discs or other structures. In the case where the porous diffuser 16 is a frame, dome, disc or other structure, gas is directed into the frame, dome, disc or other structure. The gas is released into the liquid from the porous diffuser 16 through the porous material which in these embodiments is in the form of a sheet stretched over the frame, dome, disc or other structure. In this manner, the entire structure serves as the porous diffuser 16. The type and/or composition of the particular porous diffuser 16 (whether a hose, tube, pipe or sheet) employed is not critical for practicing the present invention as long as the aforementioned properties are retained. However, the process is more efficient if the porous diffuser 16 produces a fine bubble pattern, as opposed to a coarse bubble pattern.

The arrangement of pipe described in FIG. 1 allows for a single blower 10 to supply gas to more than one porous diffuser 16 by connecting a plurality of feeder pipes 14 to supply manifold pipe 18, which in turn supply gas to the porous diffusers 16. Other arrangements for supplying gas to the porous diffuser can be constructed that are within the scope of the disclosure. For instance, the supply manifold pipe 18 and the feeder pipe 14 can be omitted, so that the outlet pipe 11 connects directly to the porous diffuser 16.

In FIG. 1, the aeration system is shown installed in and around wastewater treatment lagoon/basin 15, but can be installed in and around any body of liquid (whether man-made or naturally-occurring) desired to be aerated, such as lakes, streams, aquaculture ponds, basins. polishing ponds, chlorine contact tanks, as well as others. Lagoon/basin 15 comprises an outer portion 15A and an inner portion 15B that contains the liquid to be treated. Outlet pipe 11 and supply manifold pipe 18 are shown located entirely on the outer portion 15A, but alternative arrangements are within the scope of the present invention where all or a portion of outlet pipe 11 and supply pipe 18 are located in the inner portion 15B. The feeder pipes 14 and the outlet pipes 20 are shown located on both the outer portion 15A and the inner portion of 15B, but alternative arrangements are within the scope of the present invention where the feeder pipes 14 and outlet pipes 20 are located entirely on the outer portion 15A or entirely in the inner portion 15B.

The outlet pipe 11 and the supply manifold pipe 18 are constructed of materials as required under standard design practices for hot gasses, although the outlet pipe 11 and the supply manifold pipe 18 can be constructed of PVC if cooled by liquid or by air. The feeder pipe 14 and the outlet pipe 20 are constructed of material such as flexible polyethylene pipe or PVC pipe, but can be constructed of any material suitable for construction of pipes, and which is flexible and holds its shape to prevent kinking or breaking. The outlet pipe 11, the supply manifold pipe 18, the feeder pipes 14 and the outlet pipe 20 are connected to each other and the blower 10 by standard methods well known in the art. If commercially available porous hose is employed, the porous diffuser 16 will be equipped with standard hose connections, which can easily be adapted for connection with the feeder pipe 14 and the outlet pipe 20. The porous soaker hoses are made in lengths of 25, 50, or 75 feet, and can easily be modified to fit any basin or lagoon by connecting them in series or cutting them and re-fitting them with standard fittings for shorter lengths. The number and length of porous diffusers 16 will depend on the desired oxygen dispersion, oxygen demand of the water, or wastewater and mixing requirements of the basin for standard engineering practice, which is within the knowledge of one of ordinary skill in the art in the field of wastewater treatment.

Figure 2:
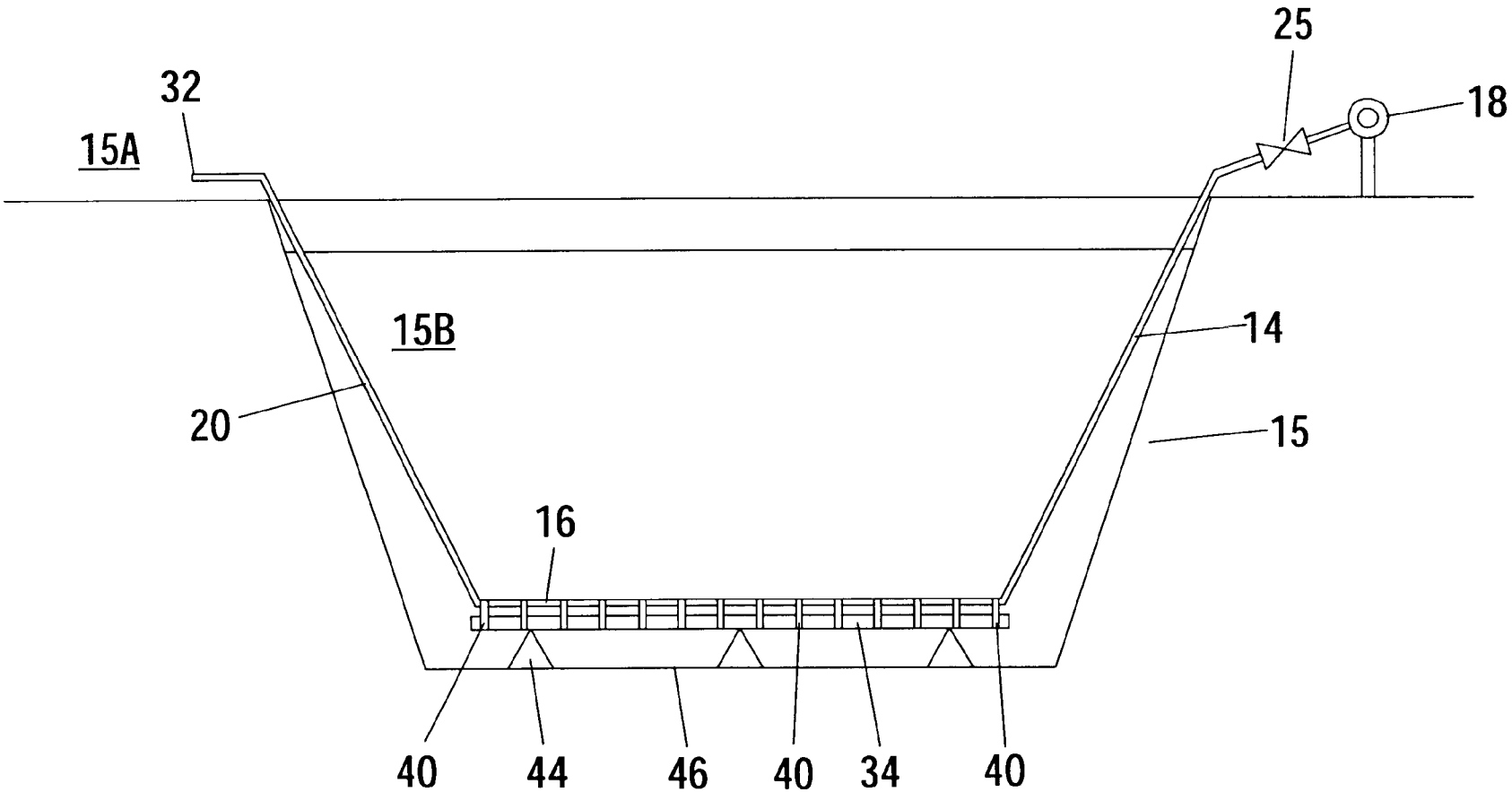
FIG. 2 is a profile view of the aeration system of FIG. 1 illustrating an embodiment of the anchoring system.
Figure 3:
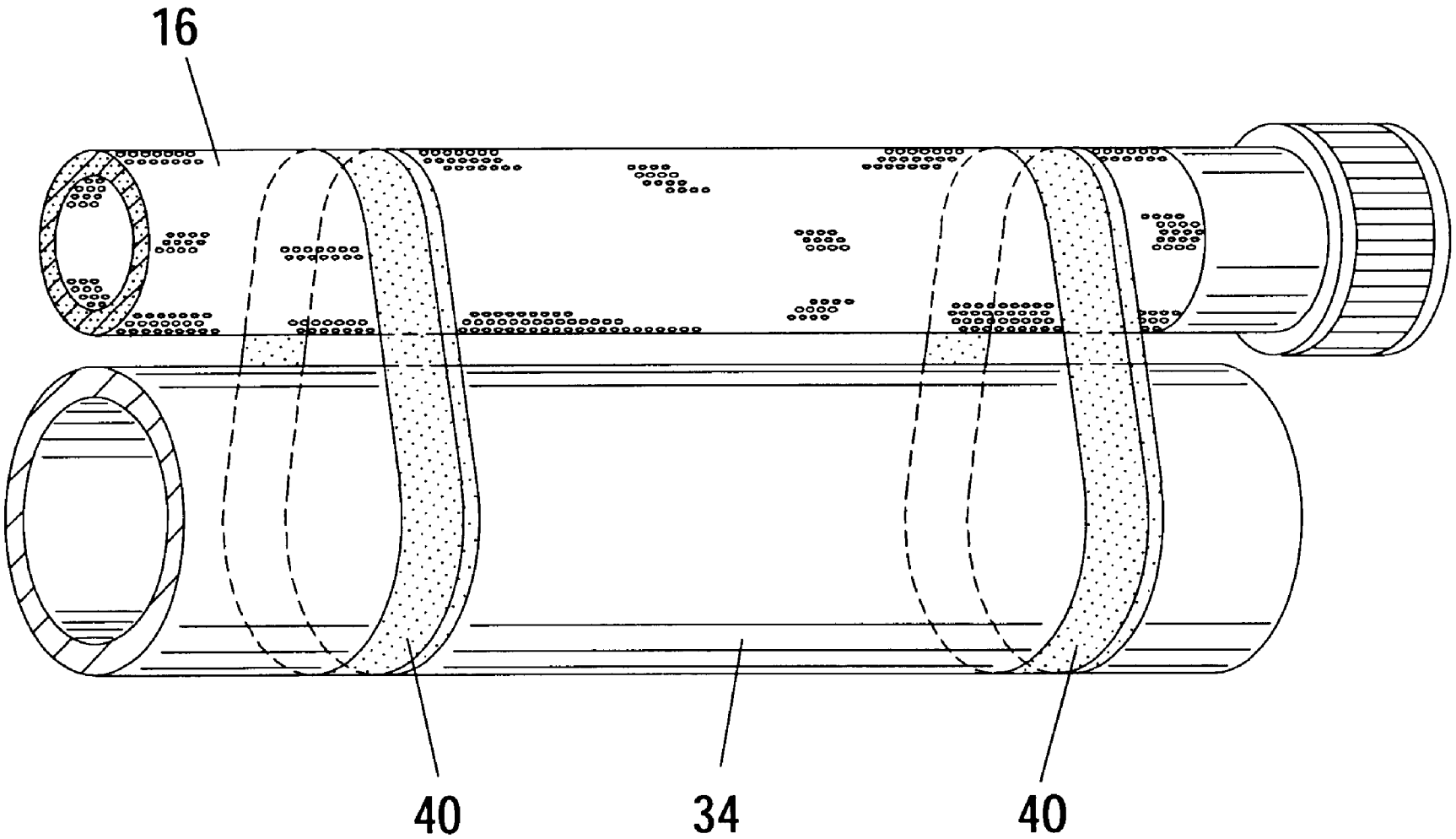
FIG. 3 illustrates an embodiment of the attachment mechanism employed to secure the porous diffuser to the stabilizing pipe.

FIG. 2 illustrates one embodiment of the anchoring mechanism, with the porous diffuser 16 shown as a porous hose as described above. Due to the buoyancy of the porous diffuser 16 when filled with gas, the porous diffuser 16 must be weighted and secured in some manner to submerge it below the surface of the liquid near the basin floor 46 (or at the bottom of any other body of liquid to be treated). To overcome the buoyancy effect, the weight of material that is used to submerge the porous diffuser 16 must be greater than the volume of the porous diffuser 16 times 62.4 lbs/ cubic foot. The porous diffuser 16 is secured to a stabilizing pipe 34. The stabilizing pipe 34 should be of such stiffness to prevent the hose from kinking, but flexible enough to fit the curvature of the basin. For example, the stabilizing pipe 34 can be constructed from 1-inch diameter Silverline Sil O flex black pipe, PE-3408, SIDR-15, 100 PSI@23 degrees Centigrade, ATSM D-2239, flexible natural gas pipe or other plastic pipes that impart the desired rigidity and flexibility. If the porous diffuser 16 kinks during operation (with one section of the porous diffuser being in a different vertical plane than the remainder of the porous diffuser), gas will tend to escape preferentially from the high points in the porous diffuser 16, or gas flow may be impeded. Both these situations may decrease the overall efficiency of the porous diffuser 16. The porous diffuser 16 can be secured to the stabilizing pipe 34 by a variety of means, including vinyl tape. plastic ties, shrink fittings, water resistant tape or other similar materials so as to prevent lateral shifting and movement along the support piping. FIG. 3 shows the stabilizing pipe 34 secured to the porous diffuser 16 by vinyl tape 40. It is preferred that the porous diffuser 16 be securely attached to the stabilizing pipe 34 in order to prevent kinking of the porous diffuser 16. Determining at what intervals to secure the porous diffuser 16 to the stabilizing pipe 34 can be determined by one of ordinary skill in the art in the wastewater treatment field, but securing the porous diffuser 16 to the stabilizing pipe 34 every 3 to 4 feet will be sufficient in most situations.

The stabilizing pipe 34 in turn is secured to weight member 44. In this manner, stabilizing pipe 34 rests on or near the basin floor 46 (or at the bottom of any other body of liquid to be treated). The stabilizing pipe 34 is securely attached to the weight members 44 at sufficient frequency to overcome the buoyancy affect, and in such a manner so that the porous diffuser 16 is at uniform depth for uniform air dispersion throughout the entire length of the diffuser. The weight member can be any material of sufficient weight to overcome the buoyancy effect of porous diffuser 16, such as a concrete block, metal anchors, standard coated, hookless boat anchors or other devices.

Alternatively, the stabilizing pipe 34 can be adapted to contain a weighting element so that the stabilizing pipe 34 provides the weight to overcome the buoyancy effect. In this configuration, there is no longer a need for the weight member 44. The stabilizing pipe 34 can be lined with a heavy material (such as a metal) or can be filled with a material of a specific gravity over 62.4 lbs/cubic foot. Examples of material that are suitable for this purpose, include, but are not limited to sand, concrete, steel rebar, or other materials with a specific gravity over 62.4 lbs/cubic foot.

In the above two embodiments of the anchoring system, if repair or replacement of the porous diffuser or other component was required, the aeration system as a whole (i.e. the porous diffuser 16, the stabilizing pipe 34, and the weight member 44, if employed) could be removed from the basin by manually pulling the aeration system from the basin and removing it. Each porous diffuser 16 can be accessed individually without disturbing the other diffusers. One end of the porous diffuser 16 can be freed from the aeration system for this operation to occur. For example, after closing the shutoff valve 25, the porous diffuser 16 could be freed from the feeder pipe 14, and the entire apparatus (porous diffuser 16, stabilizing pipe 34, weight member 44 (if employed) and any connecting pipes) is removed from the lagoon/basin 15.

Figure 4:
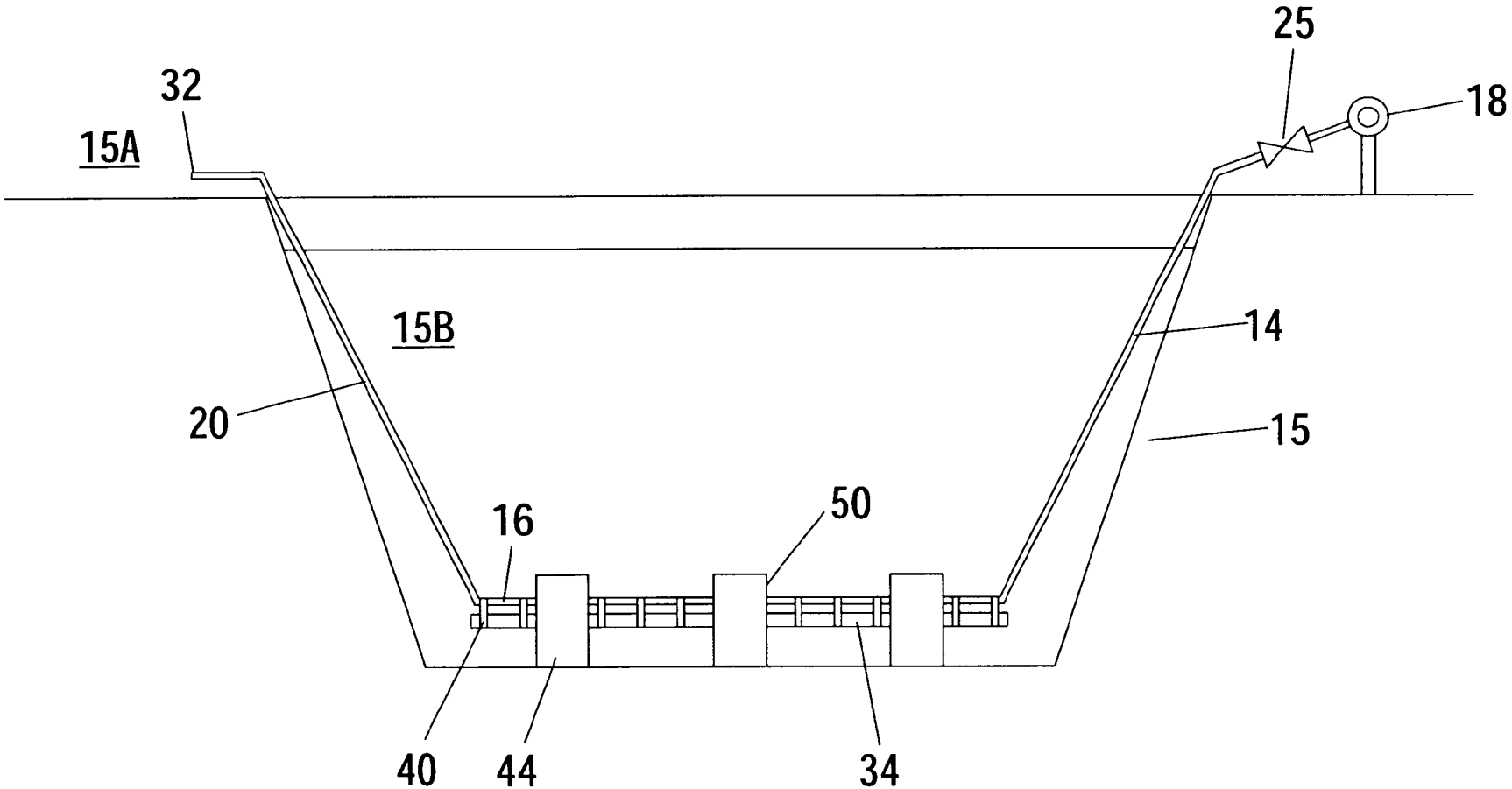
FIG. 4 illustrates an alternate embodiment of the anchoring mechanism employed to secure the porous diffuser to the stabilizing pipe.

In an alternate embodiment shown in FIG. 4, the porous diffuser may be secured to the stabilizing pipe 34 as described above and secured in place at or near the bottom of lagoon/basin 15 by threading the porous diffuser 16 and stabilizing pipe 34 through guide elements 50. Any article of sufficient weight which has a structure capable receiving the porous diffuser 16 and stabilizing pipe 34 could be used as the guide element 50. Examples include, but are not limited to, concrete blocks or anchor weights of plastic metal or concrete with an attached receiving structure (such as a ring) capable of receiving the porous diffuser 16 and stabilizing pipe 34. The concrete blocks of anchor weights could be permanently embedded in lagoon/basin 15, or simply placed on the floor of lagoon/basin 15. Therefore, the need for a weight member 44, or the need to adapt stabilizing pipe 34 to receive a weighting element is avoided. This allows for the porous diffuser 16 and stabilizing pipe 34 to be retrieved without the burden of added weight attributable to the weight member 44 or the weighting element. This embodiment is particularly useful in new installations. FIG. 4 shows guide elements 50 as concrete blocks, the concrete blocks having eyes or holes along its length to receive the porous diffuser 16 and stabilizing pipe 34. The porous diffuser 16 and stabilizing pipe 34 are threaded through an eye of the concrete blocks. When service, repair or replacement of the porous diffuser 16 is required, the porous diffuser 16 could be pulled to shore through the guide elements 50. The concrete blocks are positioned at sufficient intervals along the bottom of lagoon/basin 15 to secure the porous diffuser 16 and stabilizing pipe 34 at or near the bottom of the lagoon/basin 15. It is preferred that one end of the porous diffuser 16 be free as discussed above and that a guide line be attached (by means readily discernable to one of ordinary skill in the art) to the free end of the porous diffuser 16 so that the porous diffuser 16 and stabilizing pipe 34 could be fed back through the guide elements 50 without the need for reinstallation of the porous diffuser 16 and stabilizing pipe 34.

Again referring to FIG. 2, the outlet pipe 20 is connected to the end of the porous diffuser 16 opposite the connection to the feeder pipe 14. The outlet pipe 20 is shown extending out of the inner portion 15B to the outer portion 15A of basin 15. The outlet pipe 20 may be removably anchored to the ground to prevent its movement by any suitable means. The purging mechanism 32 is attached to the end of the outlet pipe 20 opposite the connection to the porous diffuser 16. Alternatively, the purging mechanism 32 can be attached directly to the end of the porous diffuser 16. The purging mechanism 32 will provide for purging the porous diffuser 16 of any liquid that may enter during use of the porous diffuser 16, or when the gas pressure is reduced or completely shut off. The purging mechanism 32 may comprise any element that can alternate between a closed position that stops the gas from exiting out the end of the outlet pipe 20 or porous diffuser 16 during operation, and an open position that allows the pressure of the gas to force any liquid from the end of the outlet pipe 20 or porous diffuser 16. It is contemplated that the purging mechanism 32 may be removably secured to the outlet pipe 20, or permanently attached. In the case where the purging mechanism 32 may be removed, simply removing the purging mechanism 32 and replacing it when desired will accomplish the transition between the open and closed positions described above. In the case of permanent attachment, the purging mechanism 32 will incorporate a structure to allow it to transition between the open and closed positions described above (for example, a permanently attached cap could incorporate a cover that can be manipulated to uncover the end of the outlet pipe 20 or porous diffuser 16. thereby creating the open position, and further manipulated to cover the end of the outlet pipe 20 or porous diffuser 16, restoring the closed position).

Figure 5:
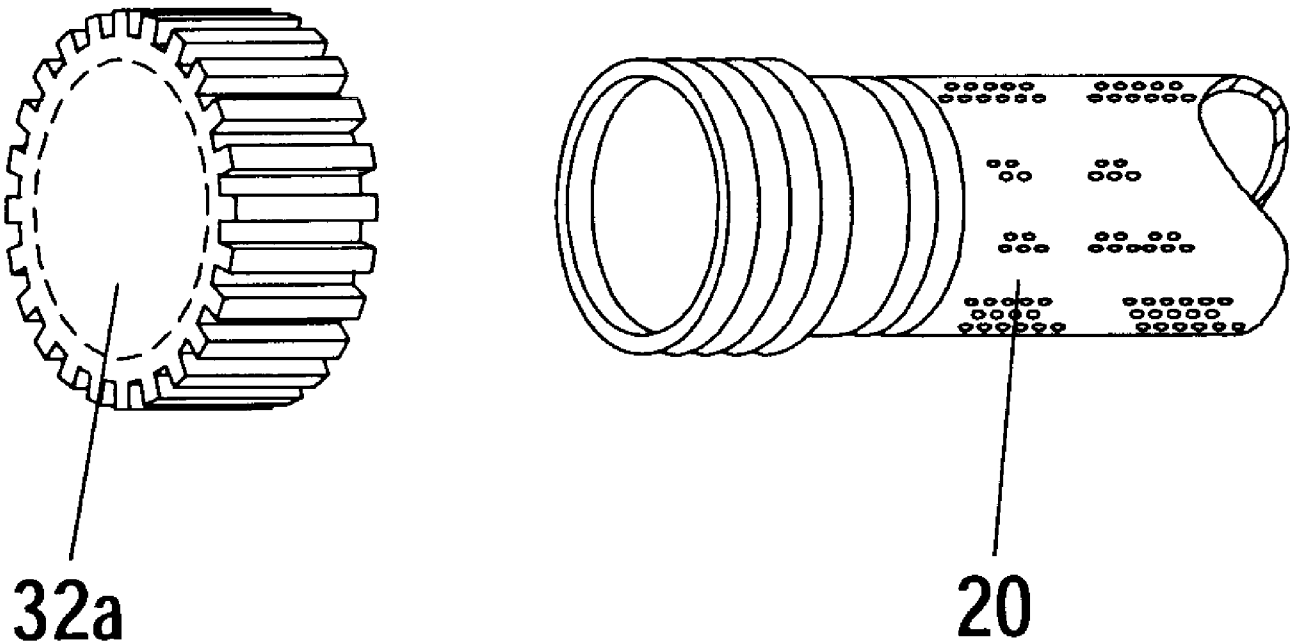
FIG. 5 is an exploded view illustrating one embodiment of the purging mechanism.

FIG. 5 shows one embodiment of the purging mechanism 32. In this embodiment, the purging mechanism 32 is simply a cap 32a secured to the end of the outlet pipe 20 or porous diffuser 16 by a standard male/female screw type connection. Other methods for attachment of the purging mechanism 32 A will be well known to those skilled in the art. However, as stated above, the purging mechanism 32 may be any element that can be inserted into or attached to the outlet pipe 20 or porous diffuser 16 that can alternate between the open and closed positions described above, such as a cap, stopper, valve, piece of cloth or other device.

EXAMPLE 1

An embodiment of the aeration system described above has undergone full scale testing at an aerated lagoon in Springville, Ala. from May, 2000, and continues as of the date of this submission. The aeration system was a replacement for a prior art system that involved the installation of numerous parallel, lead weighted tubes with either slits or pin holes to disperse air to aid in wastewater treatment. This system uses electric blowers to force filtered air through the network of distribution piping and tubing in the wastewater lagoons at low pressures of around 5 to 15 psi. Inspections of two such facilities in Alabama using these systems, which were installed in the early to mid 1980's, have revealed numerous problems with the operation and maintenance of such systems. Clogging of the diffusers (even after numerous cleaning treatments with hydrochloric acid), water logging of the tubing during blower shutdown, and disconnect of tube connections appear to be a common problem with these designs. In addition, due to the number of tubes, and the inability to easily access them, it became almost impossible to properly maintain and dependably operate such systems to provide proper wastewater treatment.

The porous diffusers used in this embodiment were commercially available porous water soaker hoses as described. The diffuser hoses were installed in a configuration similar to that shown in FIGS. 1 and 2 except that the stabilizing pipe was extended along the entire length of the feeder pipe, the porous diffusers and the outlet pipe. The stabilizing pipe was made of flexible pipe normally used in the natural gas distribution industry. Steel rebar normally used in the reinforcement of concrete were inserted into the stabilizing pipe in sufficient quantities to sink the diffuser hoses to the bottom of the lagoon/basin. The feeder pipe and the outlet pipe were also made from the above mentioned pipe used in the natural gas industry. The feeder pipe, the porous diffuser and the outlet pipe were coupled to the stabilizing pipe using plastic ties. The diffuser hoses were 75 feet in length. Plastic shutoff valves were installed on the feeder pipe, and removable plastic end caps were used as the purging mechanism to close off the outlet pipe.

The porous diffusers has exceeded expectations by providing aeration to bring dissolved oxygen (DO) levels much higher than the 2 mg/l DO levels normally required of such systems. The porous diffusers have failed to experience the fouling, clogging and water logging which had plagued the prior art lead weighted pin hole and slit aeration tubing system through its unique design and ease of maintenance. The prior art system as originally designed required over 8000 feet of lead weighted tubing, but due to the increased mixing and oxygen dispersion rate of the porous diffusers used, less than 2000 feet of tubing will be required. In addition, the operators of the system have noted that the blowers now operate smoothly without the pulsating laboring sound associated with a system that is clogged and undergoing increased pressures.

What is claimed:

1. A diffuser for aerating a body of liquid, the diffuser comprising:

a. a porous diffuser;

b. a stabilizing pipe securely attached to the porous diffuser; and c. a purging mechanism, the purging mechanism extending above a surface of the body of liquid to be aerated.

2. The diffuser of claim 1 where the porous diffuser is selected from the group consisting of:

a. a commercially available porous water soaker hose;

b. a sheet of diffuser material stretched over a frame, the sheet of diffuser material being of the same composition as the soaker hose;

c. a sheet of diffuser material stretched over the top of a dome, the sheet of diffuser material being of the same composition as the soaker hose;

d. a sheet of diffuser material stretched over a perforated membrane support tube, the diffuser material being of the same composition as the soaker hose; and e. a sheet of diffuser material stretched over the top of a disc, the sheet of diffuser material being of the same composition as the soaker hose.

3. The diffuser of claim 2 where the purging mechanism is attached directly to the porous diffuser.

4. The diffuser of claim 2 where the purging mechanism is attached to an outlet pipe connected to one end of the porous diffuser.

5. The diffuser of claim 3 or 4 where the purging mechanism is selected from the group consisting of:

a. a cap removably secured to one end of the porous diffuser or the outlet pipe;

b. a stopper removably secured to one end of the porous diffuser or the outlet pipe;

c. a cap securely attached to one end of the porous diffuser or the outlet pipe, the cap being adapted to alternate between a closed and open position;

d. a stopper securely attached to one end of the porous diffuser or the outlet pipe, the stopper being adapted to alternate between a closed and open position; and e. a valve securely attached to one end of the porous diffuser or the outlet pipe, the valve being adapted to alternate between a closed and open position.

6. The diffuser of claim 5 further comprising an anchoring mechanism.

7. The diffuser of claim 6 where the anchoring mechanism is selected from the group consisting of:

a. a weight member securely attached to the stabilizing pipe of sufficient weight to overcome the buoyancy effect of the porous diffuser;

b. a stabilizing pipe being adapted to contain weighting material sufficient to overcome the buoyancy effect of the porous diffuser; and c. a guide element of sufficient weight to overcome the buoyancy effect of the porous diffuser, the guide element capable or reversibly receiving the porous diffuser and stabilizing pipe.

8. The diffuser of claim 7 where the weight member is selected from the group consisting of: a concrete block, a metal anchor, a coated hookless boat anchor and a metal weight.

9. The diffuser of claim 7 where the weighting material is selected from the group consisting of:

sand, concrete, steel rebar and any material having a specific gravity greater than 62.4 lbs/cubic foot.

10. A diffuser for aerating a body of liquid, the diffuser comprising:

a. a means for aeration;

b. a means for stabilizing the means for aeration; and c. a means for purging, the means for purging extending above a surface of the body of liquid to be aerated.

11. The diffuser of claim 10 where the means for purging is attached directly to the porous diffuser.

12. The diffuser of claim 10 where the purging means is attached to an outlet pipe connected to one end of the porous diffuser.

13. The diffuser of claim 11 or 12 further comprising an anchoring means.

* * * * *